US009010753B2

(12) United States Patent
Shibasaki et al.

(10) Patent No.: US 9,010,753 B2
(45) Date of Patent: Apr. 21, 2015

(54) SHEET PROCESSING APPARATUS AND IMAGE FORMING SYSTEM

(71) Applicants: Yuusuke Shibasaki, Ebina (JP); Nobuyoshi Suzuki, Ebina (JP); Shingo Matsushita, Ebina (JP); Katsuhiro Kosuge, Ebina (JP); Ryuji Yoshida, Ebina (JP); Wataru Takahashi, Ebina (JP); Takashi Saito, Ebina (JP); Akihiro Musha, Ebina (JP); Takuya Morinaga, Ebina (JP); Ikuhisa Okamoto, Ebina (JP)

(72) Inventors: Yuusuke Shibasaki, Ebina (JP); Nobuyoshi Suzuki, Ebina (JP); Shingo Matsushita, Ebina (JP); Katsuhiro Kosuge, Ebina (JP); Ryuji Yoshida, Ebina (JP); Wataru Takahashi, Ebina (JP); Takashi Saito, Ebina (JP); Akihiro Musha, Ebina (JP); Takuya Morinaga, Ebina (JP); Ikuhisa Okamoto, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/278,053

(22) Filed: May 15, 2014

(65) Prior Publication Data

US 2015/0028540 A1 Jan. 29, 2015

(30) Foreign Application Priority Data

Jul. 25, 2013 (JP) ..... 2013-154477
Jan. 17, 2014 (JP) ..... 2014-006541

(51) Int. Cl.
*B65H 31/00* (2006.01)
*B65H 29/22* (2006.01)
*B65H 29/12* (2006.01)

(52) U.S. Cl.
CPC ..... *B65H 29/22* (2013.01); *B65H 29/125* (2013.01)

(58) Field of Classification Search
CPC .... B65H 2801/06; B65H 31/02; B65H 33/08; B65H 2801/27; B65H 37/04; B65H 31/34; B65H 39/11; B65H 39/043; G03G 2215/00818; B42C 1/12
USPC ..... 271/207, 213, 274; 270/58.07, 58.08, 270/58.12, 58.18
See application file for complete search history.

(56) References Cited

U.S. PATENT DOCUMENTS

| | | | | |
|---|---|---|---|---|
| 5,106,077 | A * | 4/1992 | Kawaguchi et al. | 271/302 |
| 8,382,103 | B2 * | 2/2013 | Cong et al. | 271/245 |
| 2011/0140348 | A1 * | 6/2011 | Urano et al. | 271/207 |

FOREIGN PATENT DOCUMENTS

| | | | |
|---|---|---|---|
| JP | 6-183621 | * | 7/1994 |
| JP | 2004-262656 | | 9/2004 |

* cited by examiner

*Primary Examiner* — Thomas Morrison
(74) *Attorney, Agent, or Firm* — Oblon, McClelland, Maier & Neustadt, L.L.P.

(57) ABSTRACT

A sheet processing apparatus including a stacking tray that stacks sheets, a conveying member that conveys a sheet to the stacking tray and discharges the sheet bundle from the stacking tray, wherein the conveying member includes a conveying roller and a conveying belt stretched by a plurality of stretch rollers, and a sheet processor that performs predetermined processing to the sheet bundle. When the conveying member conveys the sheet to the stacking tray, a part of the conveying belt that is not wound on the stretch roller contacts the conveying roller by moving the conveying belt as such a nip for conveying the sheet is formed. When the conveying member discharges the sheet bundle from the stacking tray, a part of the conveying belt that is wound on the stretch roller contacts the conveying roller by moving the conveying belt so that a nip for conveying the sheet is formed.

10 Claims, 19 Drawing Sheets

SHEET PROCESSING APPARATUS AND IMAGE FORMING SYSTEM

CROSS-REFERENCE TO RELATED APPLICATIONS

The present application claims priority to Japanese Application No. 2013-154477, filed Jul. 25, 2013, and Japanese Application No. 2014-006541, filed Jan. 17, 2014. The contents of the above-identified applications are incorporated herein by reference.

TECHNICAL FIELD

The present inventions relate to a sheet processing apparatus and an image forming system. In particular, the present inventions relate to a sheet processing apparatus and an image forming system including the sheet processing apparatus and an image forming apparatus, such as a copier, a printer, a facsimile machine, or a digital multifunction peripheral, and a sheet folding method performed by the sheet processing apparatus.

BACKGROUND ART

Conventionally, an image forming system includes an image forming apparatus that forms an image on a sheet, and a sheet processing apparatus that temporarily stacks the image formed sheets on a processing tray and processes the sheet bundle, such as by stapling.

JP2004-262656 discloses that a size of a processing tray in a sheet-conveying direction is half the size of the sheet. FIGS. 22A-22C, reproduced from JP2004-262656, show a diagram in which a first sheet S is conveyed on a processing tray 540.

In FIG. 22A, a swing roller 550 is located at a position apart from a driven roller 571 on standby. The sheet discharged from an image forming apparatus is conveyed to a stacking tray 504 by a discharging roller pair 508*a* and 508*b*.

In FIG. 22B, when the trailing end of the sheet S passes through the discharging roller pair 508*a* and 508*b*, the sheet S is held by the swing roller 550 and the driven roller 571.

In FIG. 22C, the sheet S is conveyed to a sheet trailing end stopper 562 by rotating the swing roller 550 and the driven roller 571 in a reverse direction to the sheet conveying direction. Next, the swing roller 550 moves upward to the standby position shown in FIG. 22A and the swing roller 550 prepares for a next sheet S to be discharged.

FIG. 23A shows a diagram that an after-next sheet S is conveyed on a processing tray 540.

However, in FIG. 23B, a following sheet S1 is conveyed to the sheet trailing end stopper 562 by rotating the swing roller 550 and the driven roller 571 while the following sheet S1 is rubbed on the previous sheet S. As such, the rear side of the following sheet S1 may be dirty with the image of the previous sheet S, and the image of the previous sheet S may deteriorate. This is because the following sheet S1 and the previous sheet S contact each other with a high surface pressure from the swing roller 550 and the driven roller 571.

SUMMARY

In light of the problems and circumstances described above, an object of the present application is to provide a sheet processing apparatus and an image forming system that prevent the rear side of the following sheet from being dirty, and prevent the image of the previous sheet from being deteriorated.

According to an embodiment of the present application, a sheet processing apparatus includes: a stacking tray that stacks sheets, a conveying member that conveys a sheet to the stacking tray and discharges the sheet bundle from the stacking tray, wherein the conveying member includes a conveying roller and a conveying belt stretched by a plurality of stretch rollers, and a sheet processing unit that performs predetermined processing to the sheet bundle. When the conveying member conveys the sheet to the stacking tray, a part of the conveying belt that is not wound on the stretch roller contacts the conveying roller by moving the conveying belt or the conveying roller so that a nip for conveying the sheet is formed. When the conveying member discharges the sheet bundle from the stacking tray, a part of the conveying belt that is wound on the stretch roller contacts the conveying roller by moving the conveying belt or the conveying roller so that a nip for conveying the sheet is formed.

DETAILED DESCRIPTION

Embodiments of the present application are described in detail with reference to the drawings.

Figure 1A:
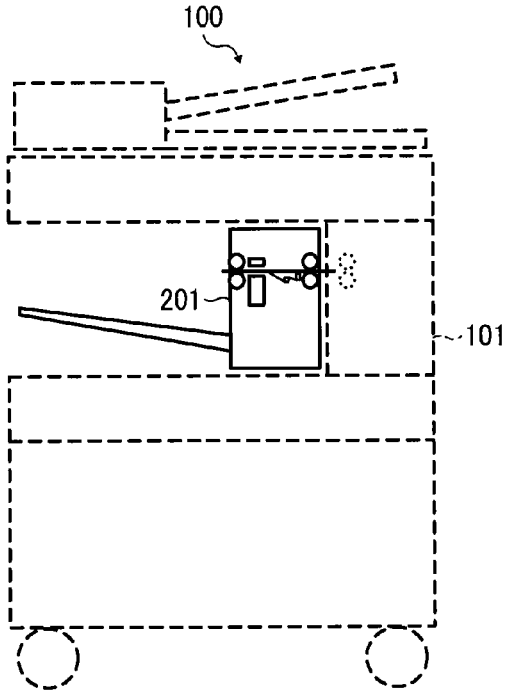
FIGS. 1A and 1B are diagram showing an overall configuration of an image forming system according to an embodiment of the present application.
Figure 1B:
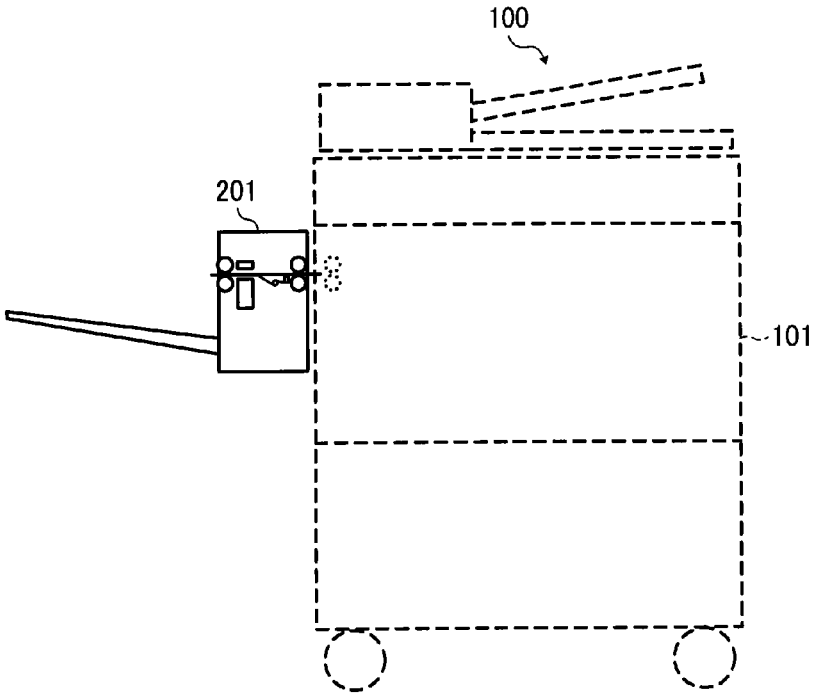

In FIG. 1A, an image forming system 100 includes an image forming apparatus 101 that forms an image on a sheet, and a sheet processing apparatus 201 that processes the image formed sheet and is arranged inside the image forming apparatus 101. On the other hand, in FIG. 1B, the image forming system 100 includes the image forming apparatus 101 and the sheet processing apparatus 201 that is arranged outside the image forming apparatus 101.

Figure 2:
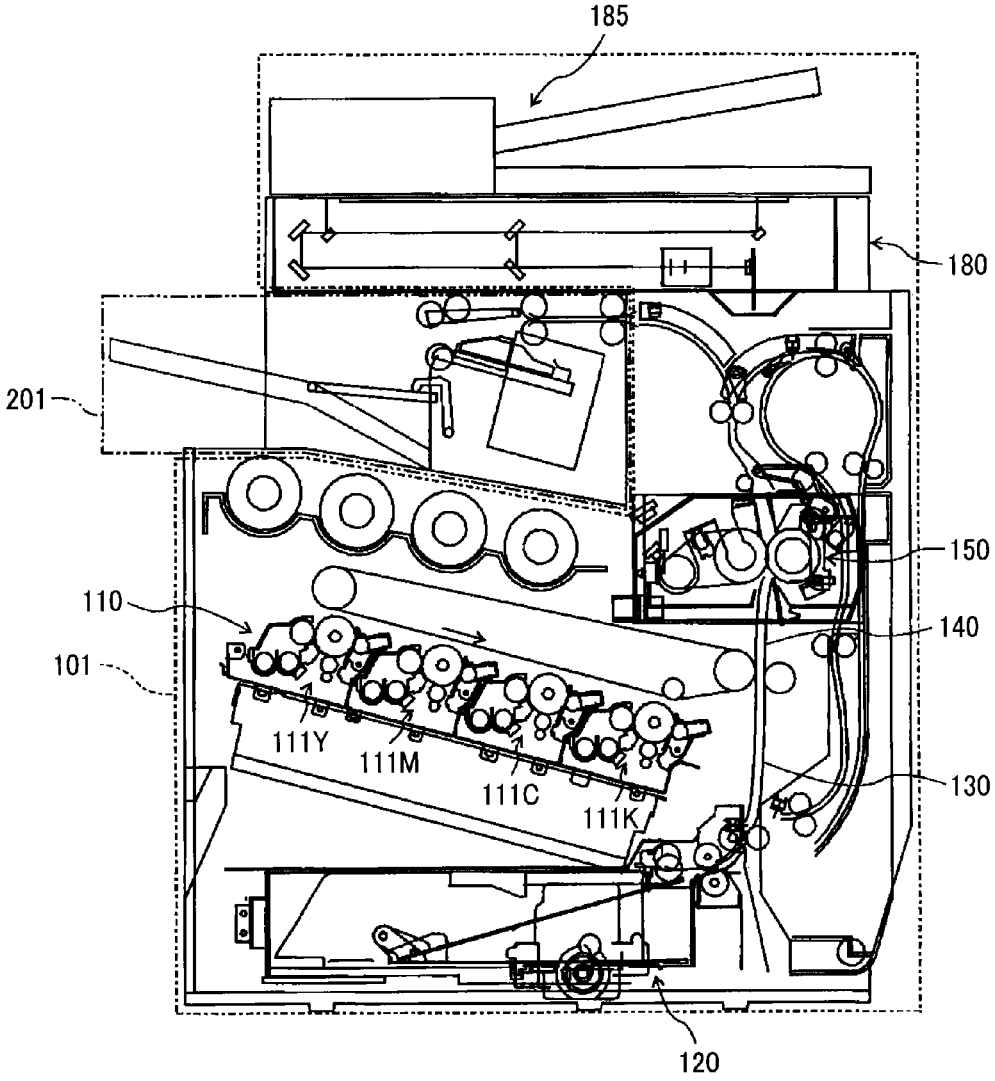
FIG. 2 is a diagram showing an overall configuration of an image forming apparatus according to an embodiment of the present application.

In FIG. 2, an imaging unit 110 is arranged in the image forming apparatus 101 and includes 4 color imaging stations 111Y, 111M, 111C, and 111K.

The image forming apparatus 101 further includes a sheet feeding tray 120, a conveying pass 130 that conveys the sheet from the sheet feeding tray 120 to a secondary transfer part 140 and a fixing part 150, a scanner 180 that scans an image of a document, and an automatic document feeder 185 (ADF) that feeds the document to the scanner 180.

The imaging unit 110 forms an image on a sheet, and the fixing part 150 fixes the image on the sheet. Next, the fixed sheet is conveyed to the sheet processing apparatus 201.

Figure 3:
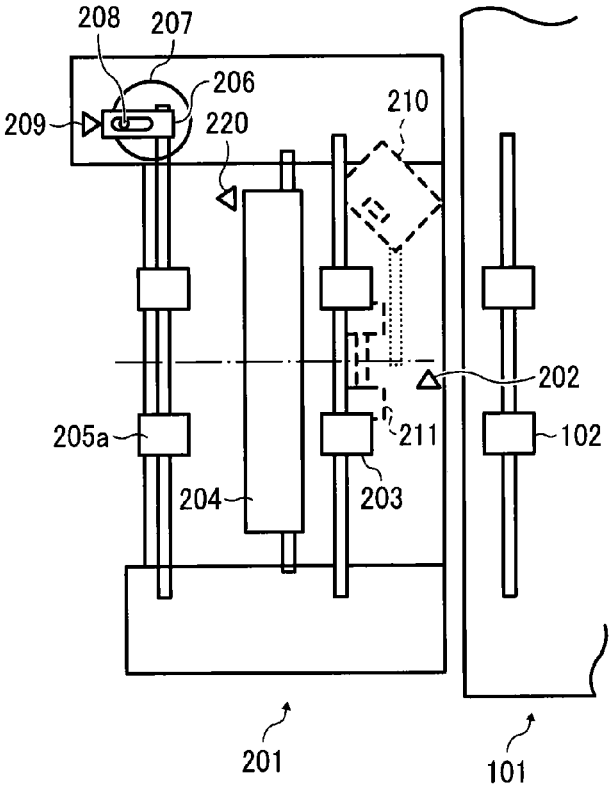
FIG. 3 is a diagram showing an overall configuration of a sheet processing apparatus according to an embodiment of the present application.
Figure 4:
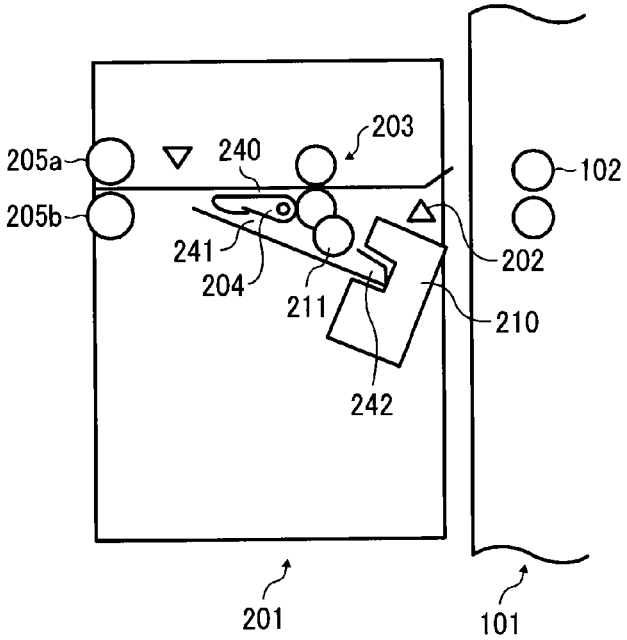
FIG. 4 is a front view of the sheet processing apparatus according to an embodiment of the present application.

In FIG. 3 and FIG. 4, the sheet processing apparatus 201 includes a inlet sensor 202, a inlet roller pair 203, a branching claw 204, a driving discharge roller 205*a*, a driven discharge roller 205*b*, a shift link 206, a shift cam 207, a shift cam stud 208, a shift home position sensor 209, a binding unit 210, and a returning roller 211.

The inlet sensor 202 detects a leading end and a trailing end of a sheet conveyed by a discharging roller pair 102 in the image forming apparatus 101.

The driving discharge roller 205*a* conveys a sheet and shifts a sheet conveying direction. The driven discharge roller 205*b* contacts the driving discharge roller 205*a* and is driven by the driving discharge roller 205*a*.

The shift link 206 is arranged at a shaft end of the driving discharge roller 205*a*. The shift cam 207 includes the shift cam stud 208, which is linked to the shift link 206. The driving discharge roller 205*a* is moved along an axis by rotating the shift cam 207.

Figure 7:
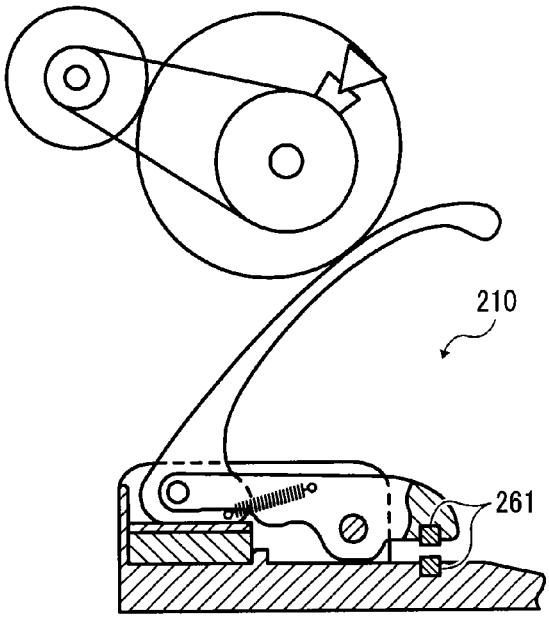
FIG. 7 is a diagram showing a binding unit in a state in which the teeth of the binding unit is opened.
Figure 8:
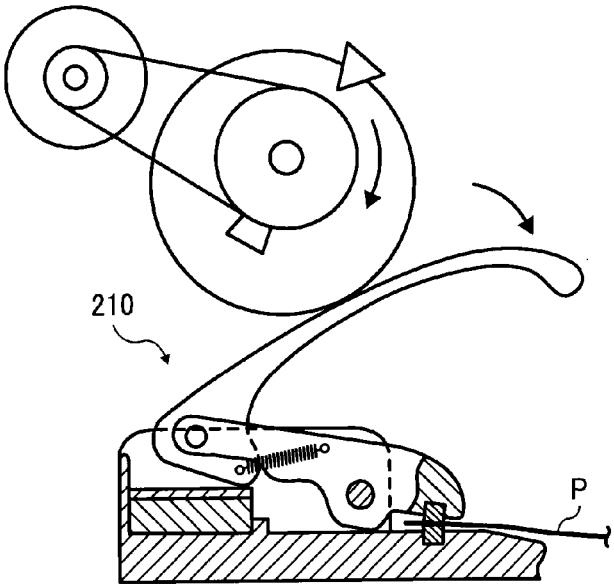
FIG. 8 is a diagram showing a binding unit in a state in which the teeth of the binding unit are closed.
Figure 9A:
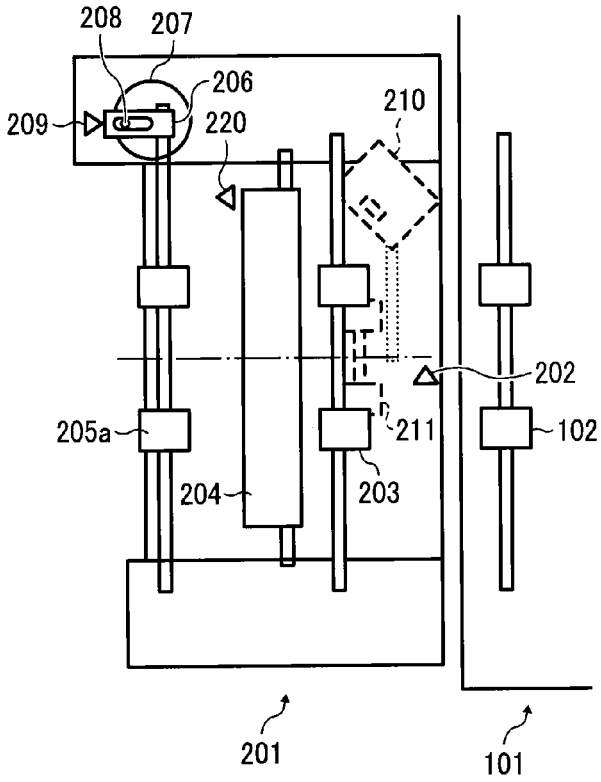
FIGS. 9A and 9B are diagrams showing a configuration of the sheet processing apparatus when an initialization is completed.
Figure 9B:
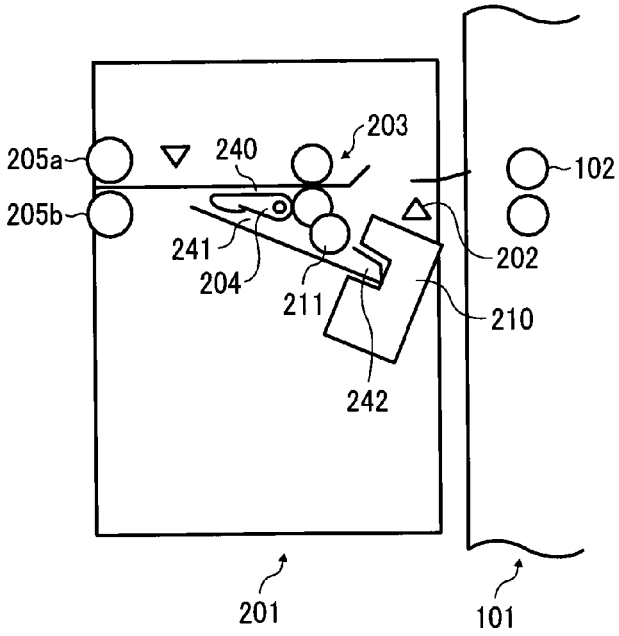

The binding unit 210 binds a sheet bundle. In FIG. 7 and FIG. 8, the mechanism of the binding unit 210 is that the sheet bundle is held by a pair of teeth 210 with convex and concave shapes so that the fibers of the sheets are tangled with each other. In one embodiment, the binding unit 210 may be a stapler.

The returning roller 211 conveys a sheet to an abutting surface 242. A sheet edge sensor 220 detects a side edge of a sheet. A conveying pass 240 guides a sheet to a discharging direction. A branch pass 241 guides a sheet to a processing tray 243. The abutting surface 242 aligns a trailing end of a sheet on the processing tray 243.

Figure 5:
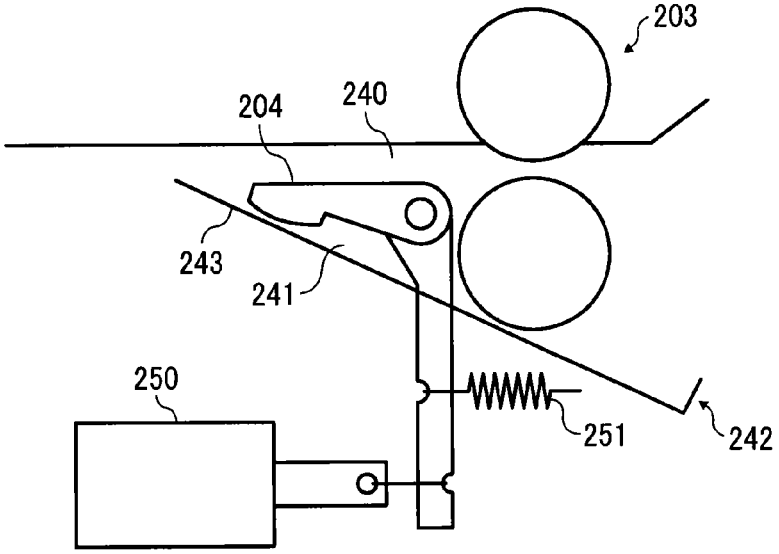
FIG. 5 is a diagram showing a home position of a branching claw for guiding a sheet that the sheet processing apparatus receives.

In FIG. 5, the branching claw 204 is rotatable to change the conveying pass 240 and the branch pass 241. As shown in FIG. 5, the branching claw 204 is pressed by a spring 251.

Figure 6:
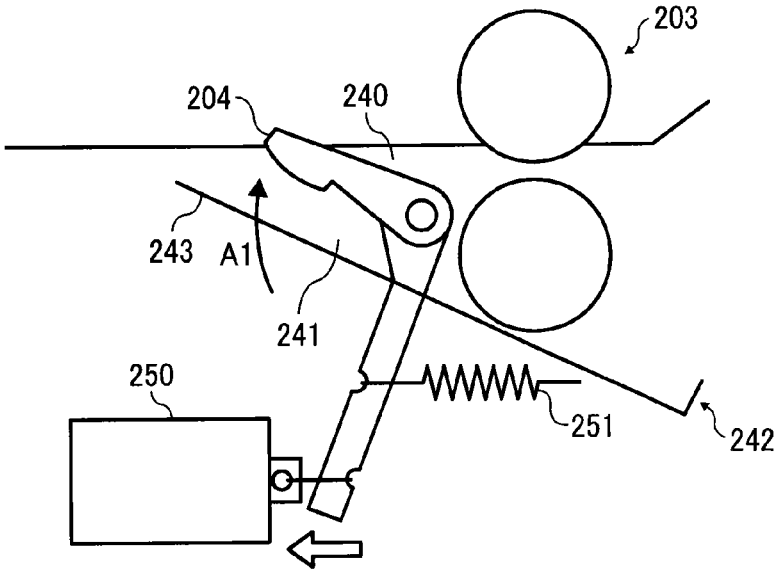
FIG. 6 is a diagram showing a position of the branching claw for guiding a sheet to a branching pass.

In FIG. 6, when a solenoid 250 is turned ON, the branching claw 204 rotates in an A1 arrow direction shown in FIG. 6 so that the sheet is guided to the branch pass 241.

Next, in FIG. 9 to FIG. 17, a binding mechanism of the sheet processing apparatus 201 is illustrated. The sheet processing apparatus 201 includes a straight mode, a shifting mode, and a binding mode.

Figure 10A:
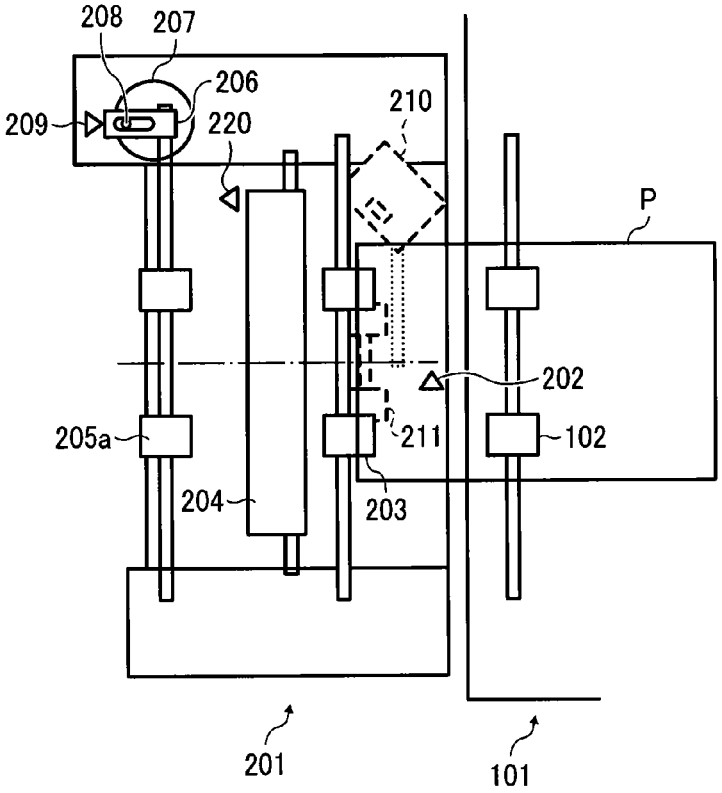
FIGS. 10A and 10B are diagrams showing a configuration of the sheet processing apparatus for receiving a sheet.
Figure 10B:
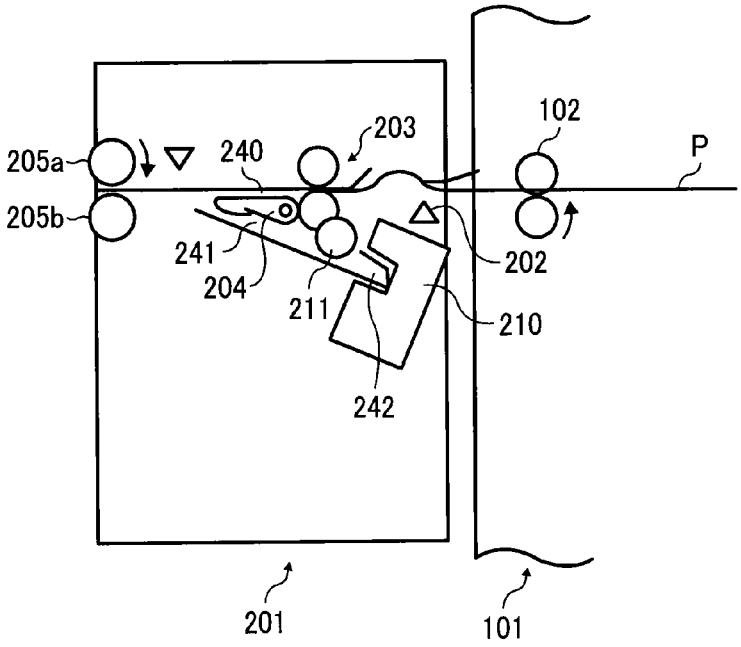

In the straight mode, as shown in FIGS. 10A and 10B, a sheet P from the image forming apparatus 101 is conveyed by the inlet roller pair 203, and is discharged by the driving discharge roller 205*a* and the driven discharge roller 205*b*.

Figure 11A:
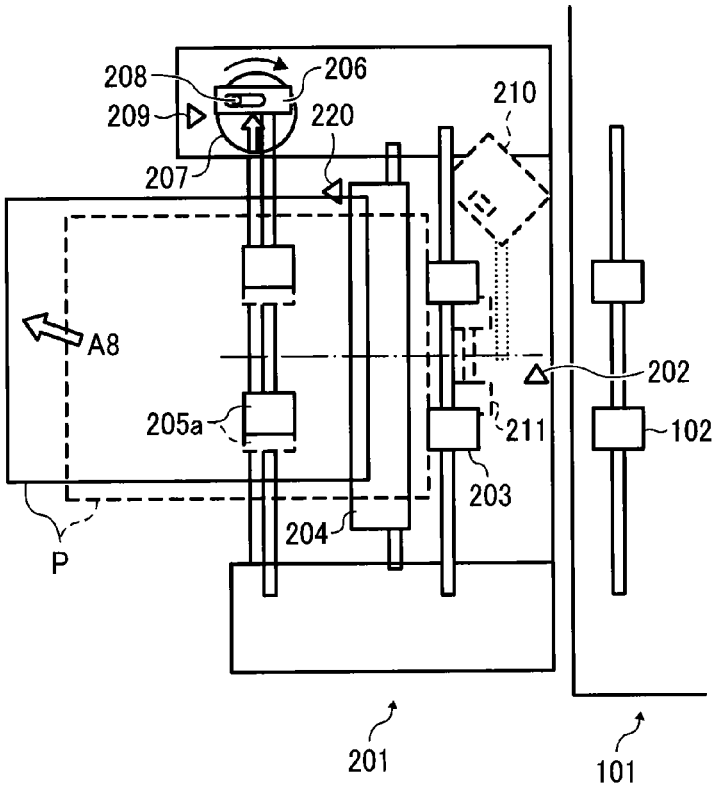
FIGS. 11A and 11B are diagrams showing a configuration of the sheet processing apparatus when a sheet is positioned in a direction orthogonal to a conveying direction.
Figure 11B:
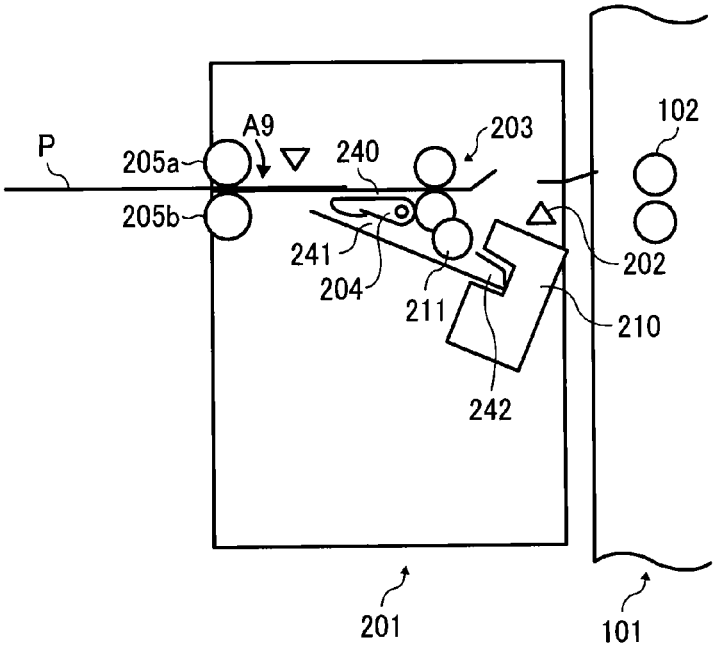

In the shifting mode, as shown in FIGS. 11A and 11B, a sheet P from the image forming apparatus 101 is conveyed by the inlet roller pair 203. When the sheet P passes through the inlet roller pair 203, the driving discharge roller 205*a* moves with the sheet P in an axis direction by rotating the shift cam 207. The shift cam 207 returns to a home position for a next sheet when the sheet P is discharged by the driving discharge roller 205*a* and the driven discharge roller 205*b*.

In the binding mode, a sheet P from the image forming apparatus 101 is conveyed by the inlet roller pair 203. When the sheet P passes through the inlet roller pair 203, the driving discharge roller 205*a* moves with the sheet P in an axis direction by rotating the shift cam 207, as shown in FIG. 11A. The sheet P is further conveyed in an A8 arrow direction by rotating the driving discharge roller 205*a* in an A9 arrow direction, as shown in FIG. 11B.

Figure 12A:
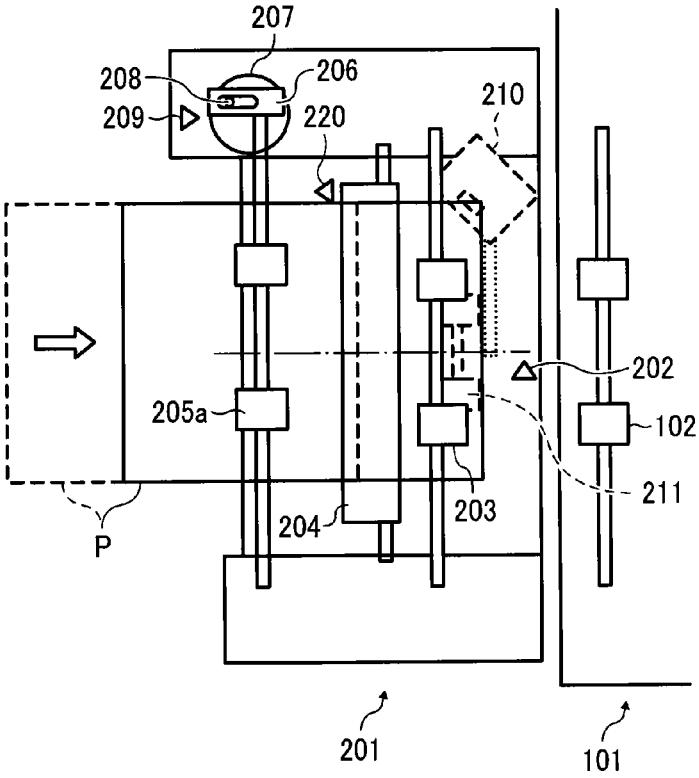
FIGS. 12A and 12B are diagrams showing a configuration of the sheet processing apparatus when a sheet is positioned in a conveying direction.
Figure 12B:
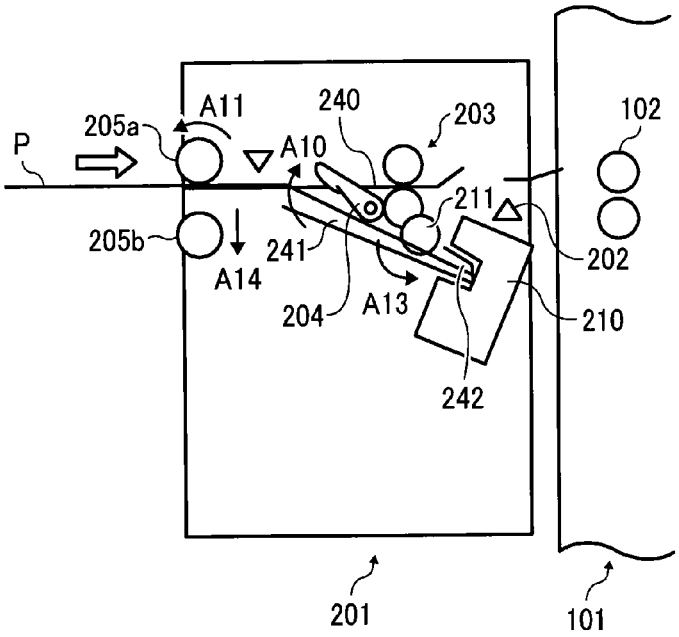

Next, as shown in FIG. 12B, when the trailing end of the sheet P passes through the tip of the branching claw 204, the branching claw 204 rotates in an A10 arrow direction. The sheet P is conveyed to the returning roller 211 in the branch pass 241 by rotating the driving discharge roller 205*a* in an A11 arrow direction. When the returning roller 211 receives the sheet P, the driven discharge roller 205*b* moves in the A14 arrow direction shown in FIG. 12B, and is apart from the driving discharge roller 205*a*. The sheet P is further conveyed to the abutting surface 242 by rotating the returning roller 211 in an A13 arrow direction. The returning roller 211 stops rotating when the trailing end of the sheet P contacts the abutting surface 242.

Figure 13A:
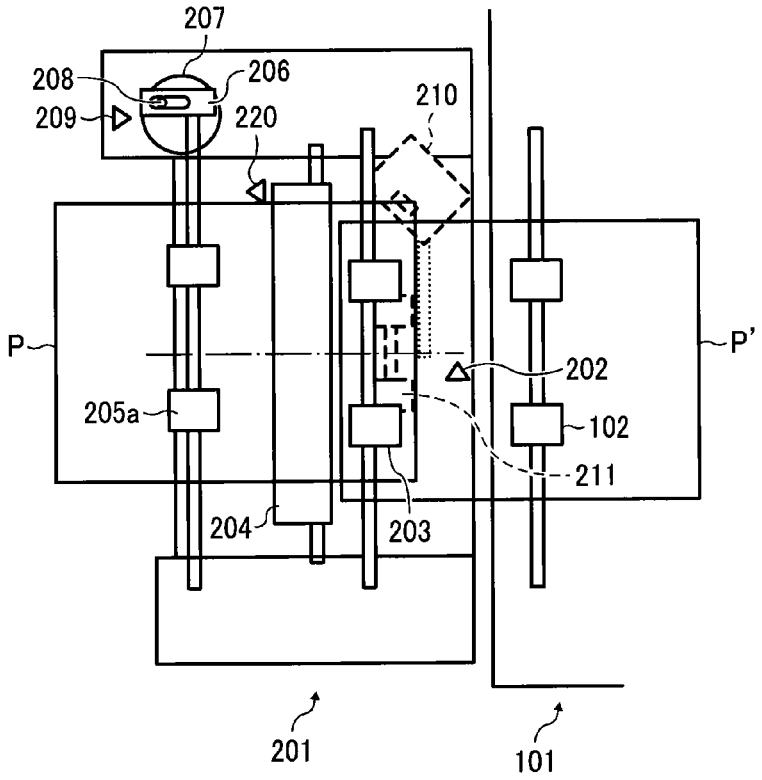
FIGS. 13A and 13B are diagrams showing a configuration of the sheet processing apparatus for receiving a following sheet.
Figure 13B:
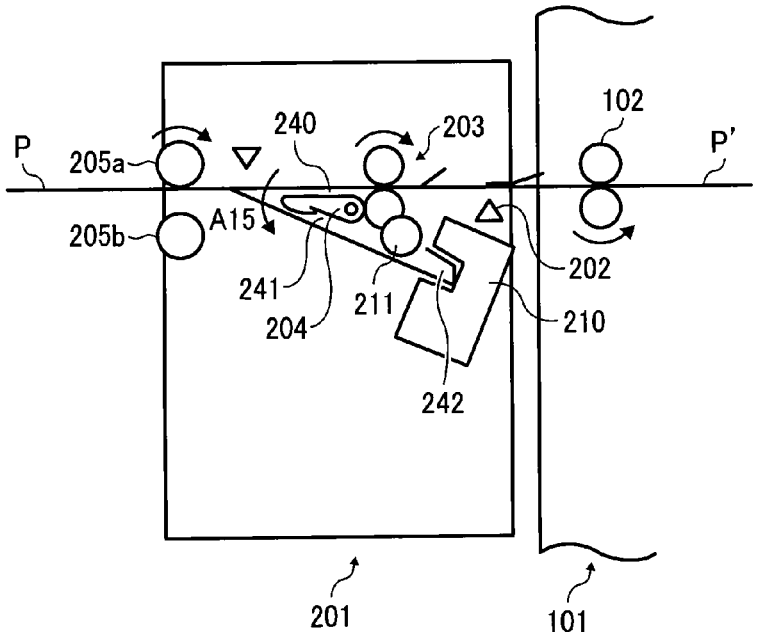

Next, in FIG. 13B, the branching claw 204 rotates in an A15 arrow direction and presses the sheet P strongly. A following sheet P' is conveyed to the driving discharge roller 205*a* by the inlet roller pair 203. When the tip of the following sheet P' passes through the driving discharge roller 205*a*, the driven discharge roller 205*b* moves in an A18 arrow direction shown in FIG. 14B and the following sheet P' is held by the driving discharge roller 205*a* and the driven discharge roller 205*b*. The sheet P on the processing tray 243 is too strongly pressed by the branching claw 204 to be conveyed by the driving discharge roller 205*a* and the driven discharge roller 205*b*.

Next an operation that is the same as the operation illustrated in FIG. 11 to FIG. 13 is conducted, and the sheets P' are stacked on the processing tray 243. Thus, following sheets are conducted repeatedly with the same operation illustrated in FIG. 11 to FIG. 14, and the sheet bundle is stacked on the processing tray 243.

Figure 15A:
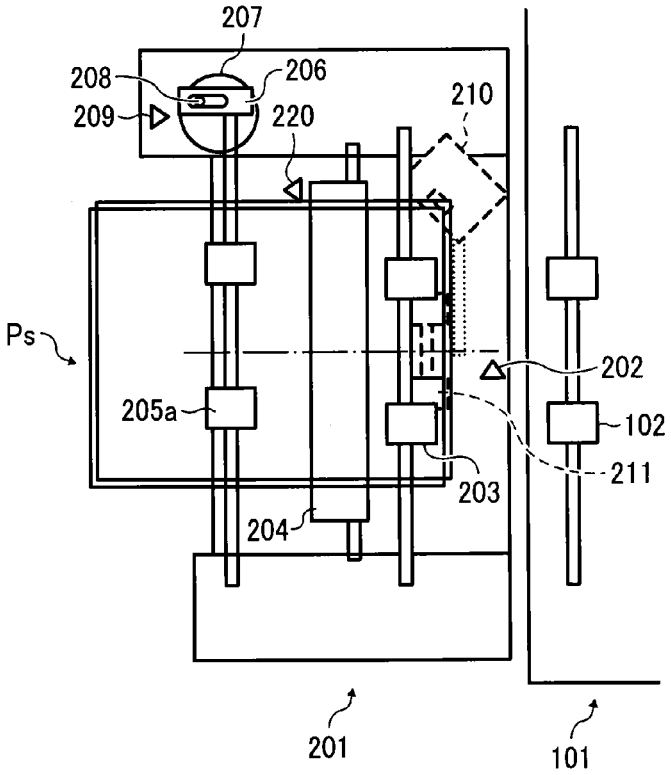
FIGS. 15A and 15B are diagrams showing a configuration of the sheet processing apparatus when a process for aligning a sheet bundle is completed.
Figure 16A:
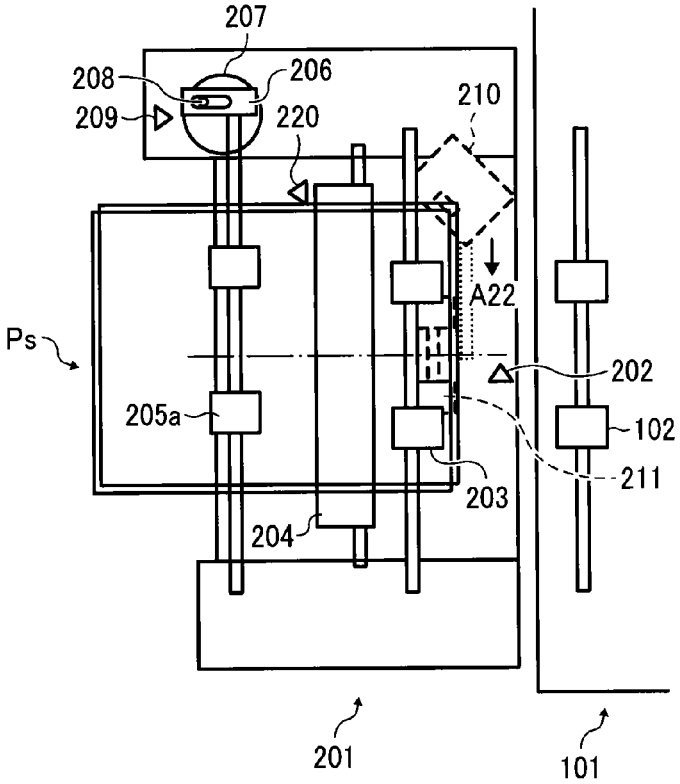
FIGS. 16A and 16B are diagrams showing a configuration of the sheet processing apparatus when a process for binding the sheet bundle is completed.

Next, in FIGS. 15A and B, the driven discharge roller 205*b* moves in an A19 arrow direction and the sheet bundle Ps is held by the driving discharge roller 205*a* and the driven discharge roller 205*b*. The branching claw 204 rotates in an A21 arrow direction and is apart from sheet bundle Ps. In FIG. 16A, the binding unit 210 moves to a binding position of the sheet bundle Ps in an A22 arrow direction. As illustrated in FIG. 7 and FIG. 8, the sheet bundle Ps is bound by the binding unit 210. Finally, the sheet bundle Ps is discharged by rotating the driving discharge roller 205*a* in an A25 arrow direction in FIG. 17A.

Figure 18A:
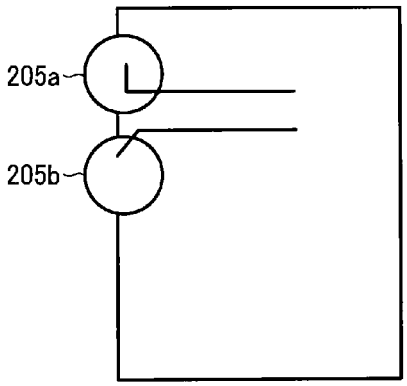
FIGS. 18A and 18B are diagrams showing a configuration of a nip formed and a non-nip formed by a discharging roller pair.
Figure 18B:
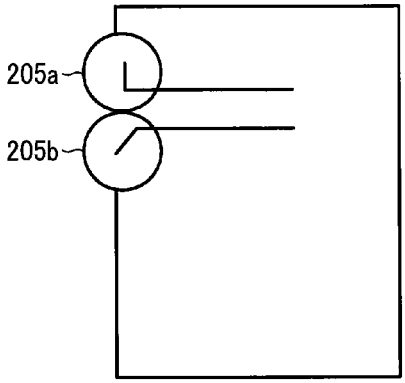

FIG. 18A is a diagram showing a configuration of a nip formed by the driving discharge roller 205*a* and the driven discharge roller 205*b*. FIG. 18B is a diagram showing a configuration of a non-nip formed by the driving discharge roller 205*a* and the driven discharge roller 205*b*.

Figure 19:
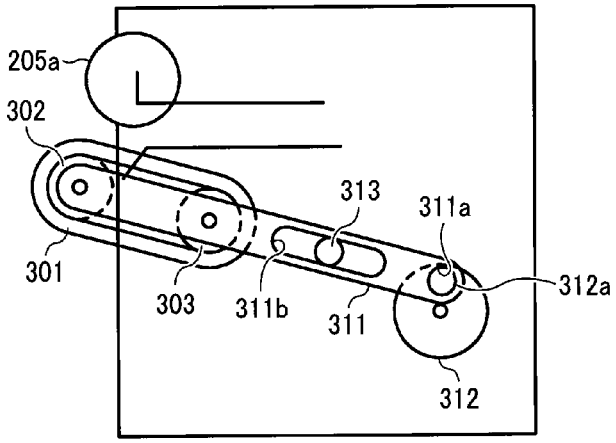
FIG. 19 is a diagram showing an overall configuration of a discharging part according to an embodiment of the present application.

FIG. 19 is a diagram showing an overall configuration of a discharging part that discharges a sheet bundle Ps on the processing tray 243. The discharging part includes the driving discharge roller 205*a*, a discharging belt 301 stretched by downstream stretch rollers 302 and upstream stretch rollers 303. The downstream stretch rollers 302 and the upstream stretch rollers 303 are attached rotatably to an end part of a holder 311. A hole part 311*a* is formed at another end part of the holder 311 and into which a projection 312*a* arranged at a cam 312 is inserted. On the other hand, a long hole 311*b* is formed around a center part of the holder 311 and is engaged with a fixed axis 313.

Figure 20A:
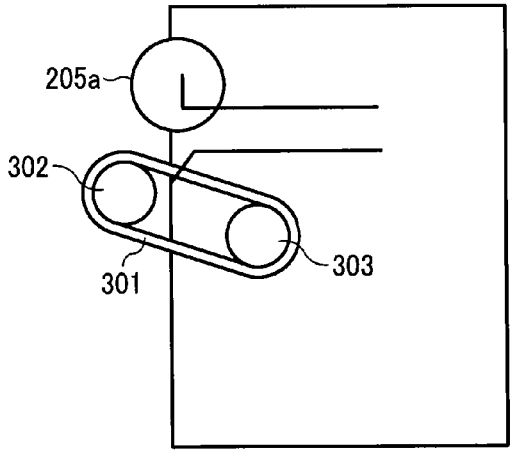
FIGS. 20A-C are diagrams showing a configuration of a nip formed and a non-nip formed by a discharging roller and a discharging belt.
Figure 20B:
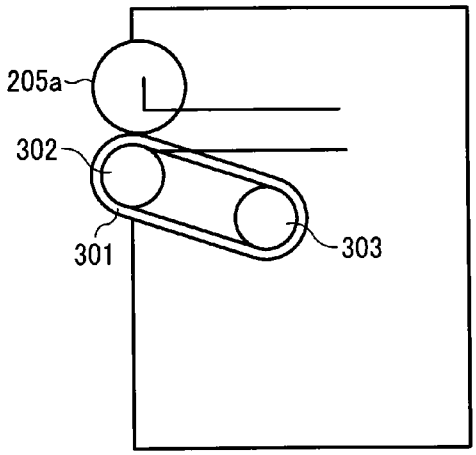
Figure 20C:
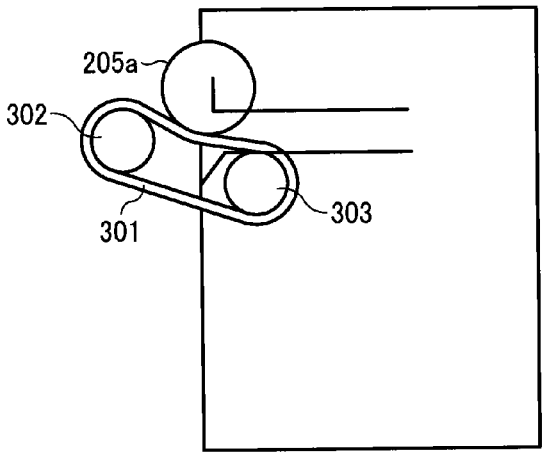

In FIGS. 20A-20C, the discharging belt 301 is moved to three positions by rotating the cam 312. A first position shown in FIG. 20A is the non-nip position at which the discharging belt 301 is apart from the driving discharge roller 205*a*. A second position shown in FIG. 20B is the roller nip position at which the part of the discharging belt 301 that is wound on the downstream stretch roller 302 contacts the driving discharge roller 205*a*. A third position shown in FIG. 20C is the belt nip position at which the part of the discharging belt 301 that is not wound on the downstream stretch roller 302 contacts the driving discharge roller 205*a*.

When the returning roller 211 receives the sheet, as shown in FIG. 12B, the discharging belt 301 moves to the non-nip position that is apart from the driving discharge roller 205*a* in FIG. 20A.

Figure 16B:
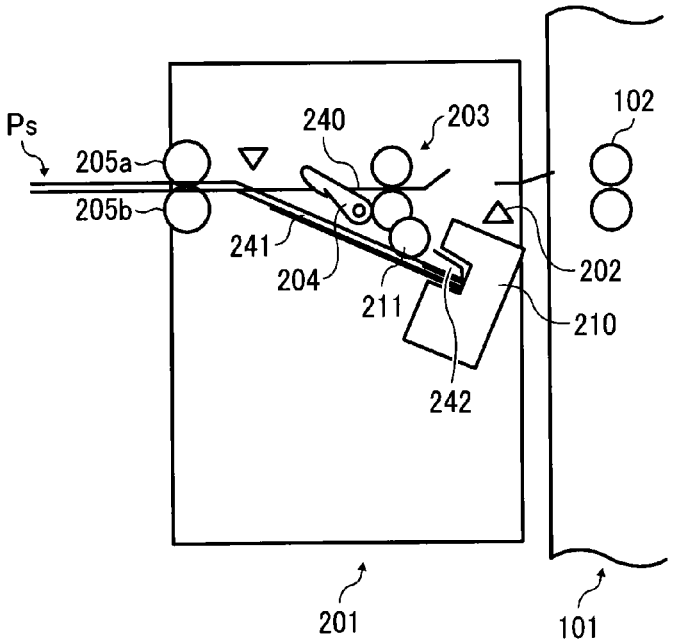
Figure 17A:
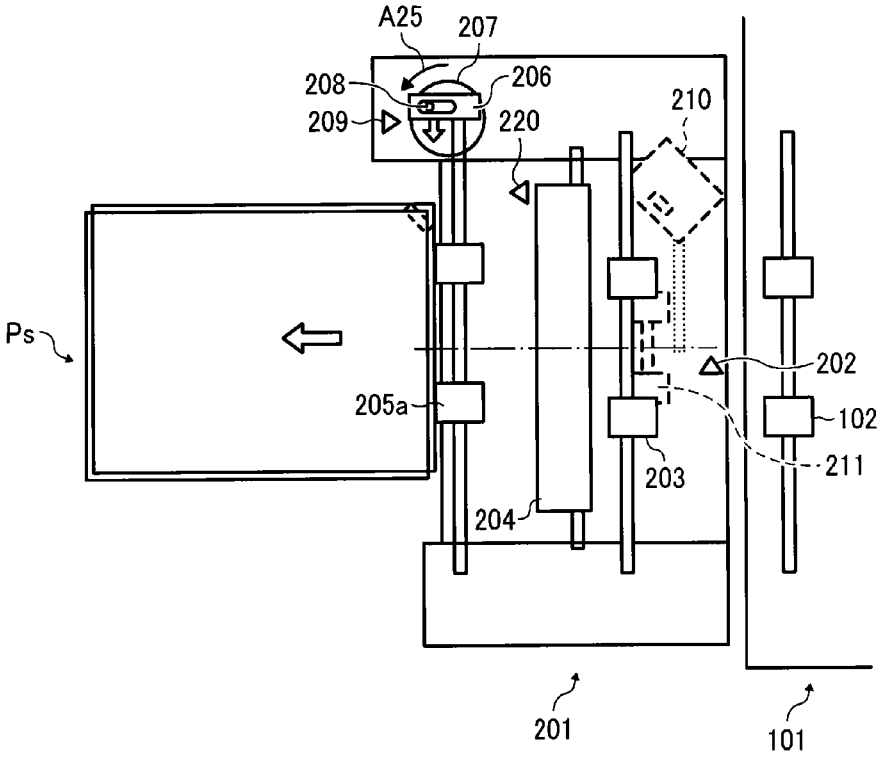
FIGS. 17A and 17B are diagrams showing a configuration of the sheet processing apparatus when a bound sheet bundle is discharged.
Figure 17B:
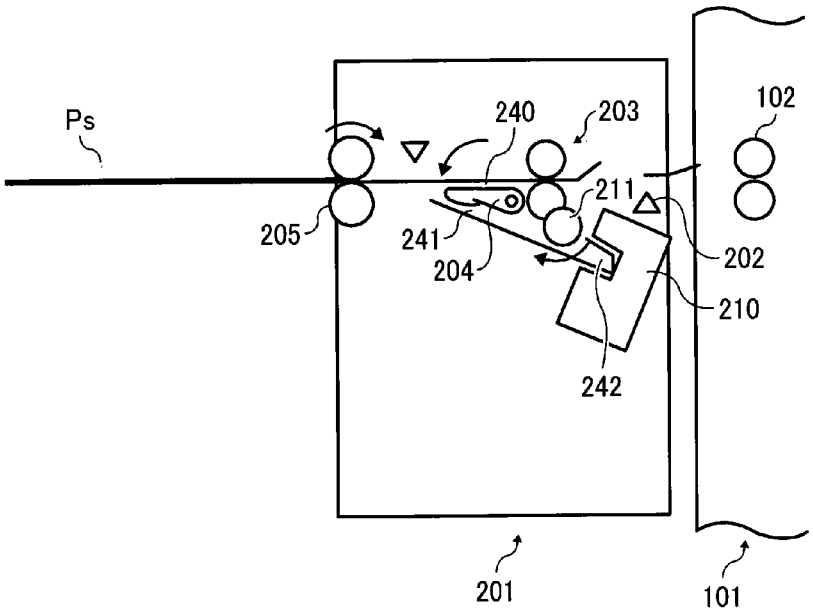

When the sheet bundle is discharged from the processing tray 243, as shown in FIG. 16 and FIG. 17, the discharging belt 301 moves to the roller nip position at which the part of the discharging belt 301 that is wound on the downstream stretch roller 302 contacts the driving discharge roller 205*a* in FIG. 20B. Thus, this structure can prevent the sheet bundle from binding too much along the driving discharge roller 205*a*, and the structure can prevent the binding part of the sheet bundle from being broken.

Figure 14A:
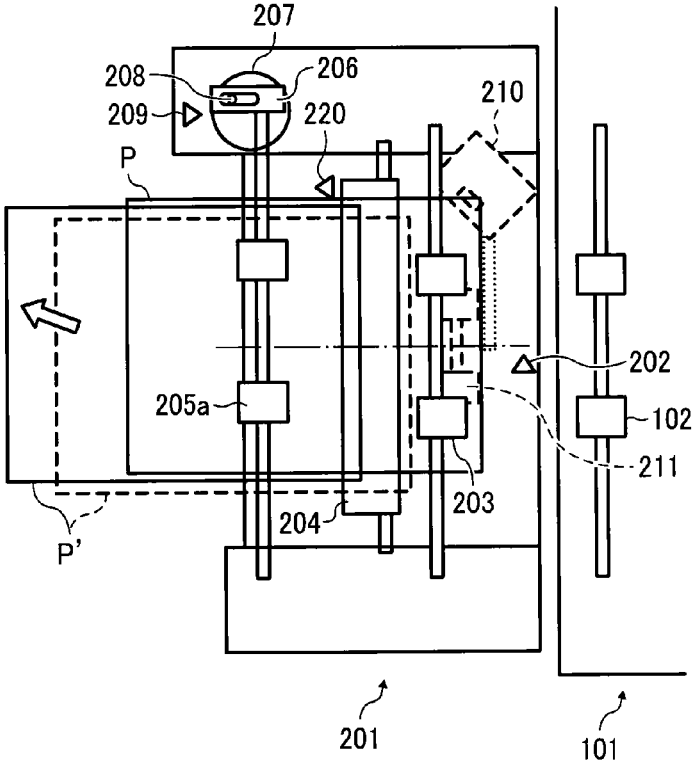
FIGS. 14A and 14B are diagrams showing a configuration of the sheet processing apparatus for further receiving a following sheet.
Figure 14B:
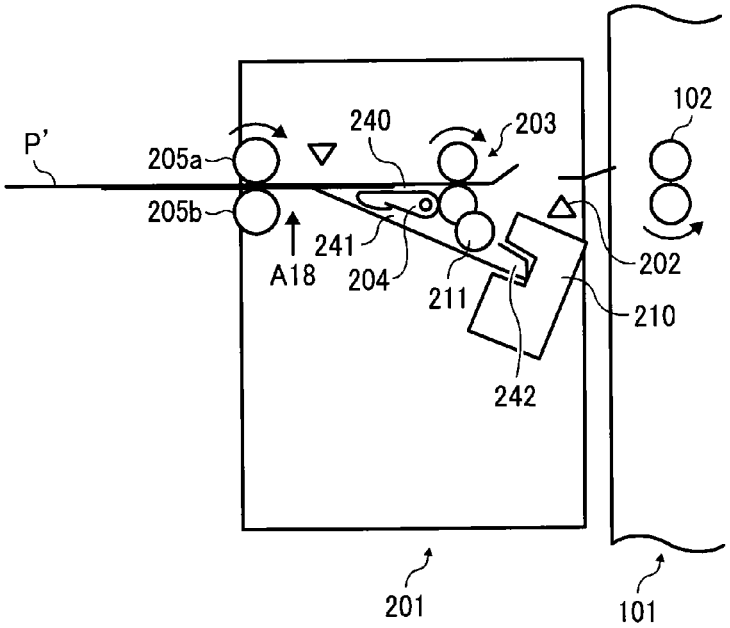
Figure 15B:
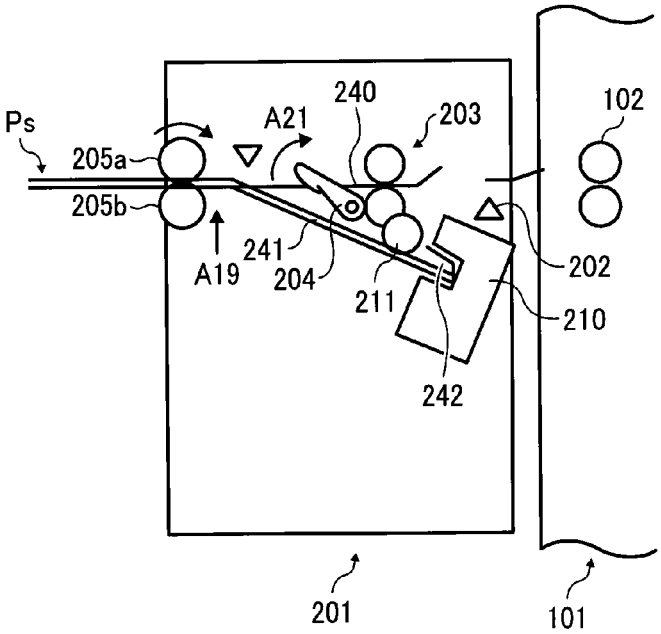

When the sheet after the second sheet is conveyed to the processing tray 243, as shown in FIG. 14 and FIG. 15, the discharging belt 301 moves to the belt nip position at which the part of the discharging belt 301 that is not wound on the downstream stretch roller 302 contacts the driving discharge roller 205*a* in FIG. 20C. As such, the nip face pressure (a pressure/a nip area) is less than that in a nip of a roller pair without reducing a pressure. Therefore, this structure can prevent the stacked sheet on the processing tray 243 and the conveying sheet from strongly rubbing each other, and the structure can prevent the image of the stacked sheet from transferring to the rear side of the conveying sheet.

Figure 21A:
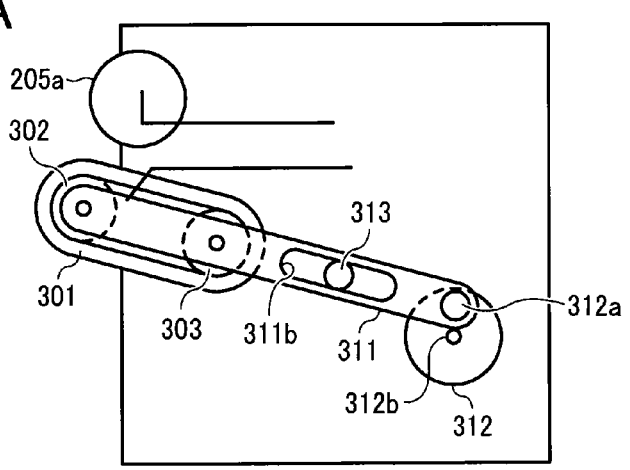
FIGS. 21A-C are diagrams illustrating a operation for changing three positions shown in FIGS. 20A-C.
Figure 21B:
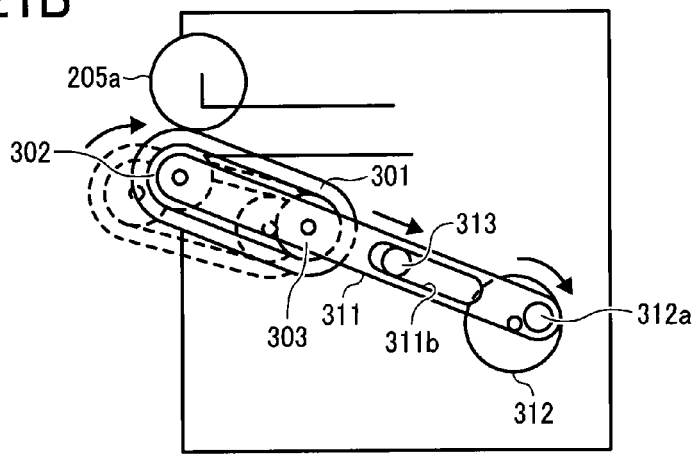
Figure 21C:
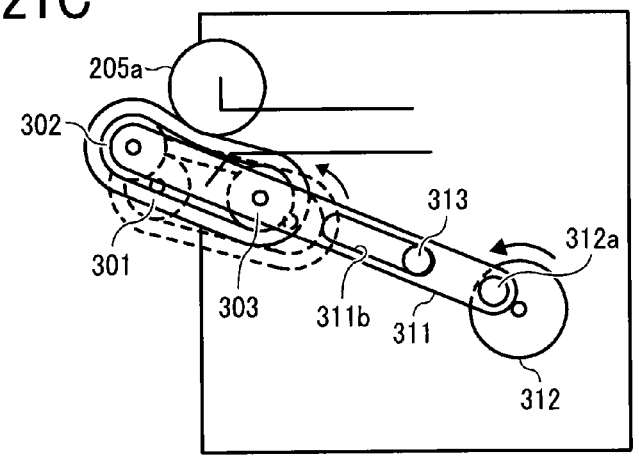
Figure 22A:
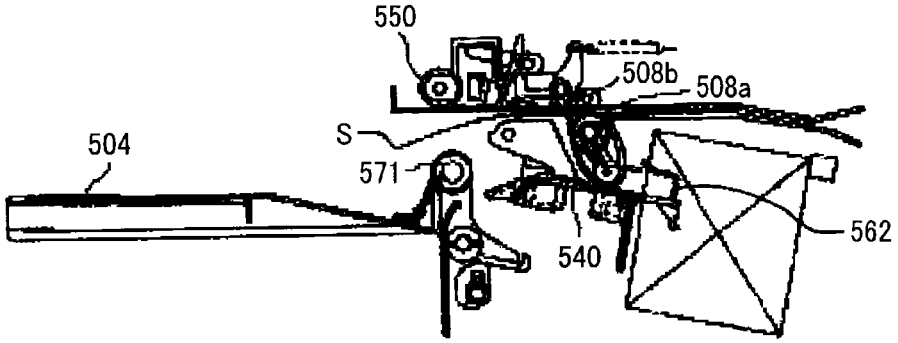
FIGS. 22A-C are diagrams illustrating a configuration of a conventional sheet processing apparatus that conveys a first sheet to a processing tray.
Figure 22B:
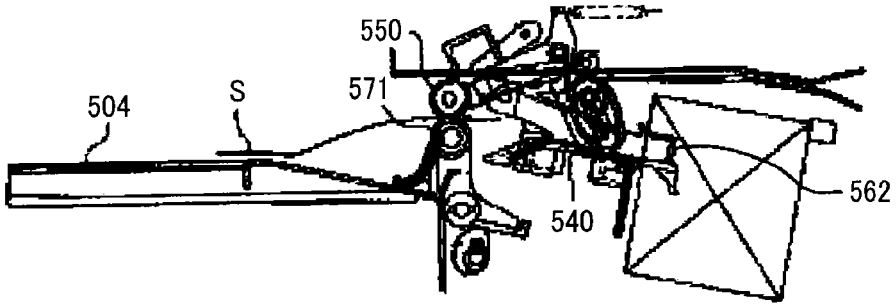
Figure 22C:
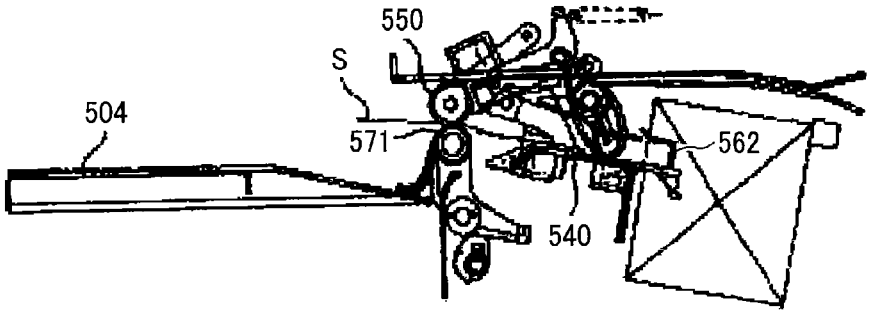
Figure 23A:
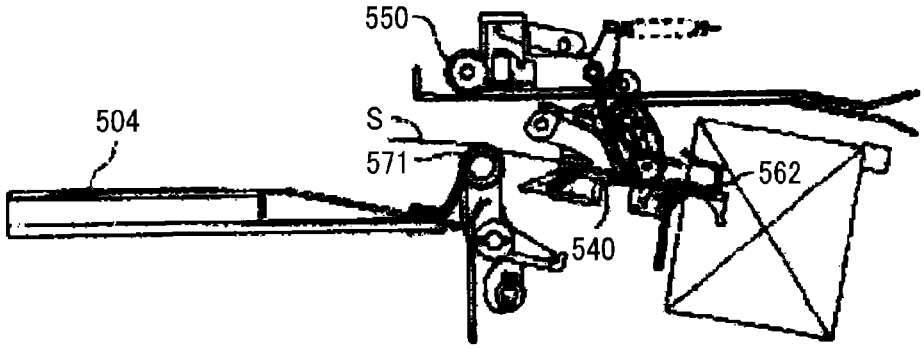
FIGS. 23A and 23B are diagrams illustrating a configuration of a conventional sheet processing apparatus that conveys an after-next sheet to a processing tray.
Figure 23B:
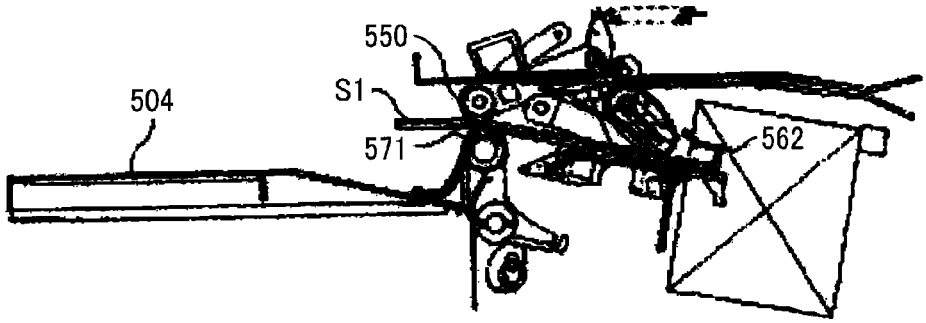

FIGS. 21A-21C are diagrams illustrating an operation for changing three positions shown in FIGS. 20A-20C.

In the non-nip position shown in FIG. 21A, the projection 312*a* arranged at the cam 312 is located above a cam axis 312*b*.

The roller nip position shown in FIG. 21B is replaced from the non-nip position by rotating the cam 312 clockwise in that figure. Thus, in FIG. 21B, the holder 311 moves in an upstream direction to a sheet conveying direction and turns around the fixed axis as a fulcrum. Therefore, the part of the discharging belt 301 that is wound on the downstream stretch roller 302 contacts the driving discharge roller 205*a*.

In one embodiment, the belt nip position shown in FIG. 21C is replaced from the non-nip position by rotating the cam 312 counterclockwise in that figure. Thus, in FIG. 21C, the holder 311 moves in a downstream direction to a sheet conveying direction and turns around the fixed axis as a fulcrum. Therefore, the part of the discharging belt 301 that is not wound on the downstream stretch roller 302 contacts the driving discharge roller 205*a*.

A pressure of the discharging belt 301 in the belt nip position may be less than a pressure of the discharging belt 301 in the roller nip position by changing a rotary angle of the cam 312 or the structure of the holder 311.

The driving discharge roller 205*a* may be replaced with a conveying belt stretched by a plurality of stretch rollers.

The above three positions, i.e., the non-nip position, the belt nip position, and the roller nip position may be changed by moving the driving discharge roller 205*a*.

The invention claimed is:

1. A sheet processing apparatus, comprising:

a stacking tray that stacks sheets;

a conveying member that conveys a sheet to the stacking tray and discharges a sheet bundle from the stacking tray, wherein the conveying member includes a conveying roller and a conveying belt stretched by a plurality of stretch rollers; and a sheet processor that performs predetermined processing to the sheet bundle, wherein when the conveying member conveys the sheet to the stacking tray, a part of the conveying belt that is not wound on the stretch rollers contacts the conveying roller by moving the conveying belt or the conveying roller so that a belt nip for conveying the sheet is formed, and when the conveying member discharges the sheet bundle from the stacking tray, a part of the conveying belt that is wound on the stretch rollers contacts the conveying roller by moving the conveying belt or the conveying roller so that a roller nip for conveying the sheet is formed, and wherein the conveying belt is relatively movable to the conveying roller so that the conveying belt is apart from the conveying roller.

2. The sheet processing apparatus as claimed in claim 1, wherein a preceding sheet on the stacking tray is held by the conveying roller and the conveying belt, when a following sheet is conveyed to the stacking tray.

3. The sheet processing apparatus as claimed in claim 1, wherein a pressure with which the conveying belt contacts the conveying roller is variable.

4. The sheet processing apparatus as claimed in claim 3, further comprising a cam that moves the conveying belt, wherein the pressure with which the part of the conveying belt that is not wound on the stretch rollers contacts the conveying roller is less than the pressure that the part of the conveying belt that is wound on the stretch rollers contacts the conveying roller by changing a rotary angle of the cam.

5. The sheet processing apparatus as claimed in claim 4, further comprising a holder connected to the conveying belt and the cam, wherein the holder includes a hole engaged to a fixed axis positioned between the conveying belt and the cam, and wherein the cam rotates and moves the holder to turn around the fixed axis as fulcrum and move the holder and the conveying belt along a sheet conveying direction.

6. An image forming system, comprising:

an image forming unit that forms an image on a sheet;

a stacking tray that stacks sheets, the sheets including respective images formed thereon;

a conveying member that conveys the sheet including the image to the stacking tray and discharges a sheet bundle from the stacking tray, wherein the conveying member includes a conveying roller and a conveying belt stretched by a plurality of stretch rollers; and a sheet processor that performs predetermined processing to the sheet bundle, wherein when the conveying member conveys the sheet to the stacking tray, a part of the conveying belt that is not wound on the stretch rollers contacts the conveying roller by moving the conveying belt or the conveying roller so that a belt nip for conveying the sheet is formed, and when the conveying member discharges the sheet bundle from the stacking tray, a part of the conveying belt that is wound on the stretch rollers contacts the conveying roller by moving the conveying belt or the conveying roller so that a roller nip for conveying the sheet is formed, and wherein the conveying belt is relatively movable to the conveying roller so that the conveying belt is apart from the conveying roller.

7. The image forming system as claimed in claim 6, wherein a preceding sheet on the stacking tray is held by the conveying roller and the conveying belt, when a following sheet is conveyed to the stacking tray.

8. The image forming system as claimed in claim 6, wherein a pressure with which the conveying belt contacts the conveying roller is variable.

9. The image forming system as claimed in claim 8, further comprising a cam that moves the conveying belt, wherein the pressure with which the part of the conveying belt that is not wound on the stretch rollers contacts the conveying roller is less than the pressure that the part of the conveying belt that is wound on the stretch rollers contacts the conveying roller by changing a rotary angle of the cam.

10. The image forming system as claimed in claim 9, further comprising a holder connected to the conveying belt and the cam, wherein the holder includes a hole engaged to a fixed axis positioned between the conveying belt and the cam, and wherein the cam rotates and moves the holder to turn around the fixed axis as fulcrum and move the holder and the conveying belt move along a sheet conveying direction.

* * * * *